US006331371B1

(12) United States Patent
Matsui

(10) Patent No.: US 6,331,371 B1
(45) Date of Patent: Dec. 18, 2001

(54) ELECTROPHOTOGRAPHIC PHOTORECEPTOR AND ITS MANUFACTURING METHOD

(75) Inventor: Naoyuki Matsui, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/376,003

(22) Filed: Aug. 19, 1999

(30) Foreign Application Priority Data

Aug. 19, 1998 (JP) ..... 10-247756

(51) Int. Cl.[7] ..... G03G 5/10
(52) U.S. Cl. ..... 430/65; 430/131
(58) Field of Search ..... 430/65, 131, 127, 430/60, 64

(56) References Cited

U.S. PATENT DOCUMENTS

| | | | | |
|---|---|---|---|---|
| 4,705,733 | * | 11/1987 | Saitoh et al. | 430/57 |
| 5,654,118 | * | 8/1997 | Yuh et al. . | |
| 5,821,026 | * | 10/1998 | Byers et al. | 430/133 |
| 5,919,591 | * | 7/1999 | Senba et al. | 430/69 |
| 5,955,231 | * | 9/1999 | Yasuda et al. | 430/69 |

FOREIGN PATENT DOCUMENTS

| | | |
|---|---|---|
| 57-16554 | 1/1982 | (JP) . |
| 57-165845 | 10/1982 | (JP) . |
| 60-186850 | 9/1985 | (JP) . |
| 60-225854 | 11/1985 | (JP) . |
| 60-252359 | 12/1985 | (JP) . |
| 60-256153 | 12/1985 | (JP) . |
| 1-316752 | 12/1989 | (JP) . |
| 3-149180 | 6/1991 | (JP) . |
| 4-304460 | 10/1992 | (JP) . |
| 5-80565 | 4/1993 | (JP) . |
| 5-88392 | 4/1993 | (JP) . |
| 6-208237 | 7/1994 | (JP) . |
| 7-92710 | 4/1995 | (JP) . |
| 8-123058 | 5/1996 | (JP) . |
| 8-227170 | 9/1996 | (JP) . |
| 10-301311 | 11/1998 | (JP) . |

* cited by examiner

*Primary Examiner*—John Goodrow
(74) *Attorney, Agent, or Firm*—Young & Thompson

(57) ABSTRACT

The electrophotographic photoreceptor according to the present invention has a conductive support (10) and a photoconductive layer laminated on the conductive support. The conductive layer is characterized by making a quantity of reflected lights with respect to exposure of a coherent light as a light source to be small and by having a short wavelength surface roughness in order to suppress a quantity of interference lights produced by the reflected lights and reflected lights from or incident lights on the photoconductive layer. Specifically, the conductive support (10) has aluminum or aluminum based alloy, and the maximum height (Ry) of the surface roughness of the conductive support is 0.8 $\mu$m or more and 2.0 $\mu$m or less. Further, the reflectivity of the light on the surface of the conductive support is equal to or less than 35% of a quantity of exposure light of a light source of a coherent light. This is able to prevent generation of the interference fringes.

The surface of the conductive support is preferably processed for an anodic oxidation film. In this case, the surface roughness subjected to the anode oxidation treatment has a roughness waveform composed of two components shown in the following equation: $1.0a \leqq b \leqq = 2.5a$, wherein, a is the roughness of the short waveform (fine roughness) component, and b is the roughness of the long waveform (coarse roughness) component.

13 Claims, 6 Drawing Sheets

| | | BARE TUBE | ABSORPTION CONDITION | ROUGHNESS Ry ON THE SURFACE OF THE ALUMETIZED BARE TUBE (μm) | | REFLECTIVITY (%) |
|---|---|---|---|---|---|---|
| | | | | REFERENCE LENGTH 0.25mm | REFERENCE LENGTH 0.8mm | |
| EMBODIMENT | 1 | a | 55°C/6min | 0.90 | 1.20 | 28 |
| | 2 | b | 45°C/9min | 1.05 | 1.35 | 25 |
| | 3 | c | 60°C/5min | 0.85 | 1.00 | 28 |
| | 4 | d | 65°C/8min | 1.20 | 1.55 | 32 |
| | 5 | e | 50°C/6min | 1.40 | 1.80 | 34 |
| COMPARATIVE EXAMPLE | 1 | f | 75°C12min | 0.70 | 1.40 | 42 |
| | 2 | g | 90°C/5min | 0.55 | 0.85 | 48 |
| | 3 | h | 35°C/9min | 0.60 | 1.30 | 45 |
| | 4 | i | 65°C/10min | 1.50 | 2.50 | 18 |

FIG.4

| | | BARE TUBE | ADMITTANCE (S/m2) | CONTACT ANGLE (DEGREES) | NUMBER OF CRYSTALLIZED PARTICLES AND PITS | |
|---|---|---|---|---|---|---|
| | | | | | MAXIMUM DIAMETER(μm) | NUMBER(NUMBER/mm2) |
| EMBODIMENT | 1 | a | 6.9 | 64 | 2.0 | 300 |
| | 2 | b | 20.3 | 38 | 1.0 | 150 |
| | 3 | c | 2.6 | 67 | 1.5 | 300 |
| | 4 | d | 0.96 | 70 | 1.5 | 450 |
| | 5 | e | 11.3 | 52 | 2.0 | 450 |
| COMPARATIVE EXAMPLE | 1 | f | 0.37 | 82 | 4.0 | 3000 |
| | 2 | g | 0.22 | 83 | 4.0 | 2800 |
| | 3 | h | 33.8 | 15 | 5.0 | 2500 |
| | 4 | i | 0.75 | 75 | 1.5 | 550 |

FIG.5

| PRIBATE | | BARE TUBE | HEAT RESISTANCE TEST (135deg.c/ONE HOUR × 3 CYCLE) | HEAT RESISTANCE |
|---|---|---|---|---|
| EMBODIMENT | 1 | a | NO CRACK | ○ |
| | 2 | b | NO CRACK | ○ |
| | 3 | c | NO CRACK | ○ |
| | 4 | d | NO CRACK | ○ |
| | 5 | e | NO CRACK | ○ |
| COMPARATIVE EXAMPLE | 1 | f | OCCURRENCE OF CRACK | × |
| | 2 | g | OCCURRENCE OF CRACK | × |
| | 3 | h | NO CRACK | ○ |
| | 4 | i | NO CRACK | ○ |

FIG.6

| PRIVATE | | DRUM | EXISTENCE OF INTERFERENCE FRINGES | IMAGE CHARACTERISTICS | | |
|---|---|---|---|---|---|---|
| | | | | 10℃/20%/RH | 25℃/50%/RH | 35℃/80%/RH |
| EMBODIMENT | 1 | a | NONE | EXCELLENT | EXCELLENT | EXCELLENT |
| | 2 | b | NONE | EXCELLENT | EXCELLENT | EXCELLENT |
| | 3 | c | NONE | EXCELLENT | EXCELLENT | EXCELLENT |
| | 4 | d | NONE | EXCELLENT | EXCELLENT | EXCELLENT |
| | 5 | e | NONE | EXCELLENT | EXCELLENT | EXCELLENT |
| COMPARATIVE EXAMPLE | 1 | f | EXISTENCE | COATING IRREGULARITY, BLACK SPOTS | COATING IRREGULARITY, BLACK SPOTS | COATING IRREGULARITY, BLACK SPOTS, FOGS |
| | 2 | g | EXISTENCE | COATING IRREGULARITY, BLACK SPOTS | COATING IRREGULARITY, BLACK SPOTS | COATING IRREGULARITY, BLACK SPOTS, FOGS |
| | 3 | h | EXISTENCE | BLACK SPOTS | BLACK SPOTS | BLACK SPOTS, FOGS |
| | 4 | i | NONE | COATING IRREGULARITY | COATING IRREGULARITY | COATING IRREGULARITY |

FIG.7

ELECTROPHOTOGRAPHIC PHOTORECEPTOR AND ITS MANUFACTURING METHOD

BACKGROUND OF THE INVENTION

1. Field of the Invention

The present invention relates generally to an electrophotographic photoreceptor and its manufacturing method utilized particularly in a copying machine, a printer, or a facsimile machine and used when an imaging operation is performed with an electrophotographic process.

2. Description of the Related Arts

As is conventional, an imaging system using an electrophotographic photoreceptor forms a toner image on a surface of the photoreceptor by forming an electrostatic latent image with a laser exposure and by developing the image with toner particles to render the image visible after the surface of the photoreceptor with photoconductive property is charged by the corona discharge. The photoreceptor is composed of a conductive support and a photoconductive layer formed on the conductive support and consists of a charge generating layer and a charge transporting layer. The toner image on the photoreceptor is transferred on a recording medium by a transferring device.

In an electrophotographic process described above, a semiconductor laser (with a wavelength of 650 to 820 nm) generally used as a light source during laser exposure has a monochromatic light with a coherent property. In this case, an interference may be occurred between incident lights being incident on the surface of the photoreceptor from the semiconductor laser and reflected lights produced by reflection of lights on the surface of the conductive support which lights have transmitted through the photoconductive layer on the surface of the photoreceptor. As a result of its interference, an image defect referred to as interference fringe (moire fringe) pattern may be occurred. In particular, when a high gradient is required in a halftone and solid image and an image with horizontal ruled line patterns, there was a problem in which a defect in the electrostatic latent image was apt to occur which might become a cause of the moire fringes when a latent image was formed with a laser.

The cause of this interference will be explained hereinafter. That is, the charge generating layer in the photoconductive layer generates carriers according to the absorption of light, however, the charge generating layer tends to be made thin in order to shift the carriers generated to the charge transporting layer smoothly. Therefore, a quantity of light which is not absorbed in this charge generating layer transmits through the charge generating layer and is reflected on the surface of the conductive support. Its reflected light is believed to make interference with the reflected light from and the incident light onto the surface of the photoconductive layer, resulting in nonuniformity of contrast with the interference fringe pattern.

As prevention measures of this interference fringes, it is known that methods of expecting the scattering effect such as a method of including a light scattering substance in a underlying layer (Japanese Patent Laid-Open No. Sho 57-165845) and subjecting the surface of the conductive support to the burnishing process (Japanese Patent Laid-Open No. Hei 3-149180) or to the sand-blasting process (Japanese Patent Laid-Open No. Sho 57-16554), a method of increasing the absorbance in the charge generating layer to make the reflected light faint, and a method of making the surface of the conductive support rough in moderation (Japanese Patent Laid-Open Nos. Sho 60-186850, Sho 60-225854, Sho 60-252359, and Sho 60-256153).

Further, what causes problems in an electrophotographic photoreceptor is that a local electrification defect based on an imperfection of the photoreceptor, and the defect often causes a conspicuous image failure such as black spots and fogs. Various reasons can be considered for causing the local electrification defect, and many of the reasons are considered such that the defect is based on the local charge injection between the conductive support and the photoconductive layer.

Many of the conductive support use aluminum or aluminum based alloy. On the other hand, it can be considered to provide a blocking layer between the conductive support and the photoconductive layer in order to improve the problem of the interference. As the blocking layer, as is conventional, there is a method of providing a resin layer, such as polyamide, polyimide, polyvinyl alcohol, polyurethane, casein, or cellulose, or an inorganic layer, such as aluminum oxide, aluminum hydroxide, or the like. An inorganic layer, that is, an anodic oxidation film, is itself a homogeneous film without a pin-hole, however, the homogeneity of the film is dependent on compositions of the conductive support, because aluminum ions of the conductive support are consumed during anode oxidation treatment. If crystallized particles exist on the conductive support, recesses referred to as pits cause the surface to be uneven, thereby not only affecting manufacture of the photoconductive layer, but also causing an image defective. Therefore, in view of preventing the interference fringes described above, it was essential to control the surface figuration of the finish condition of the photoreceptor.

Some amount of Mg, Si, Cu, Ti, or the like is added to an aluminum alloy used in the conductive support in order to keep a constant strength, however, impurities such as Fe and Mn derived from an aluminum base metal are also included in the aluminum alloy. These elements form crystallized particles in the course of making an aluminum alloy to be ingot and shaping it to a tubular conductive support. These crystallized particles have chemical properties different from that of aluminum, so that they were dissolved antecedently in the anode oxidation treatment to cause the crystallized particles in the neighborhood of the surface to be left out, resulting in generation of pits.

As mentioned above, there were following problems in the prior art.

(1) A method of providing an asperity process (rough surface process) on a surface of the conductive support is typically used as it can obtain the prevention effect for interference fringes independent of the configuration of the photoconductive layer. To provide specific asperities on the surface of the conductive support can expect some amount of the prevention effect due to the light scattering effect as such. However, the complete cancellation of the interference fringes can not be achieved because factors of reflected lights still exist. Further, there were problems such that risk of increasing charge injection from heights made too rough, and also ground fog tends to occur, particularly in white solid printing.

(2) Many rough surface processes conduct the burnishing process or the sand-blasting process as the second processing, after a surface of the conductive support is once subject to the cutting process, so that the productivity was very wrong, therefore, these processes were not suitable for mass production.

In addition, qualitatively in processing, a periodical processing pattern tends to be formed on the surface of the conductive support. In particular, when surface roughness Ry (when a reference length of 0.8 mm is measured in JIS Standard) becomes larger than 2.0 μm, swell and flocculation state on a coating film of the photoconductive layer would be generated, so that not only coating irregularity is apt to be produced, but also stripe like noise becomes a large problem. On the contrary, when Ry (when a reference length of 0.25 mm is measured in JIS Standard) is less than 0.8 μm, in a case of a photoreceptor, problems such as a light interference and an excessive exposure phenomenon due to a laser would tend to be occurred.

Incidentally, in JIS Standard, the reference length during the measurement of the roughness is a reference value for measuring the roughness of a measurement object, and it shows a length of an interval including an arbitrary number of top and bottom portions in a roughness waveform in which tops and bottoms of the roughness periodically come out. When the roughness is large, the reference length of 0.8 mm measurement is conducted, and when it is small, the reference length of 0.25 mm measurement is performed. A result measured (value of Ry) corresponds to a peak value of a waveform in which high frequency portions in the roughness waveform are eliminated, that is, the maximum height in projection portions on a surface of the conductive support.

(3) Defectives such as pits or the like can not be prevented even if a high purity aluminum alloy is used for the conductive support. In addition, a method for decreasing the defectives in the process of the anode oxidation treatment can also not prevent the change of crystallized particles already formed in the course of making an aluminum alloy to be ingot and shaping it to be tubular. This method uses high purity aluminum alloy and requires a high precision rectifier operation for current, forcing a product to be expensive.

Further, the blocking layer produced using an anodic oxidation film and a macromolecular resin obtained by these methods would be difficult to eliminate an image defective such as black spots and fogs, and in particular, multiple fogs would be generated under the high temperature and humidity environment.

(4) On the other hand, the conventional method using an anodic oxidation film has disadvantages such that variability tends to be generated in the blocking effect and heat-resistant characteristic is poor. Accordingly, problems would be encountered concerning generation of cracks on the surface during drying process, or coating irregularity, deterioration of electric insulation breakdown strength, or growth of cracks into the photoconductive layer during formation of the photoconductive layer. Therefore, it is necessary to form an anodic oxidation film without such drawbacks.

SUMMARY OF THE INVENTION

It is an object of the present invention to provide an electrophotographic photoreceptor and its manufacturing method which can prevent generation of interference fringes under every operating environment and obtain excellent images having high gradient with no image failure.

The electrophotographic photoreceptor according to the present invention comprises a conductive support and a photoconductive layer composed of a charge generating layer and a charge transporting layer laminated on the conductive support. The conductive support is characterized by making a quantity of reflected lights with respect to exposure of a coherent light as a light source to be small and by having a short wavelength surface roughness in order to suppress a quantity of interference lights produced by the reflected lights and reflected lights from or incident lights on the photoconductive layer.

Specifically, the conductive support comprises aluminum or aluminum based alloy, and the maximum height (Ry) of the surface roughness of the conductive support is 0.8 μm or more when the reference length of JIS Standard of 0.25 mm is measured, and 2.0 μm or less when the reference length of 0.8 mm is measured. Further, it is desirable that the reflectivity of the light on the surface of the conductive support is equal to or less than 35% of a quantity of exposure light of a light source of a coherent light of 700 nm or more.

In JIS Standard, the reference length during the measurement of the roughness is a reference value for measuring the roughness of a measurement object, and it shows a length of an interval including an arbitrary number of top and bottom portions in a roughness waveform in which tops and bottoms of the roughness periodically come out. When the roughness is large, the reference length of 0.8 mm measurement is conducted, and when it is small, the reference length of 0.25 mm measurement is performed. A result measured (value of Ry) corresponds to a peak value of a waveform in which high frequency portions in the roughness waveform are eliminated, that is, the maximum height in projection portions on a surface of the conductive support.

This was able to prevent generation of the interference fringes when laser light exposes an electrophotographic photoreceptor, and confirm that the interference fringes were not revealed in an image. Additionally, there was an effect to suppress an excessive exposure. Furthermore, occurrence of black spots and fogs was able to be suppressed.

In the present invention, a surface of the conductive support is desirable to be processed by an anodic oxidation film. In this case, it is desirable that the surface roughness subjected to an anode oxidation treatment has a roughness waveform composed of two components shown in the following equation, a pitch between projects of asperities in an a waveform of first component is 5 to 20 μm, and a pitch between projects of asperities in a b-waveform of second component is 200 to 400 μm. Equation (1) was obtained from experiments.

$$1.0a \leqq b \leqq 2.5a \qquad \text{Equation (1)}$$

wherein:

a is the roughness of the short waveform (fine roughness) component;

b is the roughness of the long waveform (coarse roughness) component.

By fulfilling Equation (1), the reflectivity of light on the surface of the conductive support was able to be kept to equal to or less than 35% of a quantity of exposure light of a light source of a coherent light of 700 nm or more, so that black spots in an image and occurrence of fogs under the high temperature and humidity environment were able to be more fully suppressed.

In the present invention, the asperity figuration on the surface of the conductive support may be composed of only slope portions.

In the case of the present invention, it is desirable that the contact angle of the anodic oxidation film with pure water is in the range from 30 to 80 degrees, and admittance is in the range from 0.4 to 30 $S/m^2$.

By making the contact angle in the way described above, adhesion of dust during formation of the photoconductive layer can be avoided, and further, application of a paint on the photoconductive layer can be made uniform, so that unevenness of the paint and generation of black spots can be prevented.

In addition, from the condition of the admittance described above, even if the anodic oxidation film is dried while maintaining the electrification property of the photoreceptor, generation of crack can be prevented, and also heat-resistant property of the anodic oxidation film is improved.

By making the average of diameters of crystallized particles on the anodic oxidation film to be 3 $\mu$m or less and the distribution of the crystallized particles to be 1000/mm$^2$ or less, recesses, referred to as pits, were not occurred on the conductive support and the surface figuration was improved, contributing to formation of an excellent image.

Further, it is desirable to suppress the crystallized particles on the anodic oxidation film that the conductive support is composed of Fe of 0.3 weight percent or less based on the weight of aluminum, Mg of 0.4 to 0.6 weight percent or less, and Mn of 0.1 weight percent or less.

It is preferred that the present invention is provided with an anodic oxidation film whose surface is absorption processed by an acetic acid nickel solution under conditions of treatment temperature of 40 to 65° C. and treatment time of 4 to 10 minutes.

The method for manufacturing an electrophotographic photoreceptor according to the present invention is such that a photoconductive layer composed of a charge generating layer and a charge transporting layer is laminated on a conductive support consisting of aluminum or aluminum alloy. The method is characterized by processing a surface of a conductive support with a high precision processing lathe and by absorption-processing a surface of an anodic oxidation film with acetic acid nickel solution.

Specifically, the absorption-processing of the acetic acid nickel solution is characterized to be performed under the treatment temperature of 40 to 65 degrees and treatment time of 4 to 10 minutes.

In the method of the present invention, before the anodic oxidation film is formed on the conductive support, the conductive support is degrease-processed with an organic solvent or treatments such as a surface-active agent or an emulsified degreasing agent. Next, the conductive support is subjected to etching processing and anode oxidation treatment in an acid solution bath to form an anodic oxidation film. Next, the anodic oxidation film is immersed in an aqueous solution containing the acetic acid nickel to subject to the absorption-process, thereafter, the charge generating layer is laminated on the anodic oxidation film and the charge transporting layer is built-up on the charge generating layer.

In the present invention, one or more intermediate layers composed of a resin or resins including conductive particulate may be laminated on the anodic oxidation film before the charge generating layer is laminated.

BRIEF DESCRIPTION OF THE DRAWINGS

FIG. 4 is a view showing absorption conditions of absorption processes with acetic acid nickel in embodiments from 1 to 5 and comparative examples from 1 to 4, and measuring results of surface roughness and surface reflectivity of an alumetized bare tube;

FIG. 5 shows measuring results of admittance, contact angle of pure water, and number of crystallized particles and pits produced in embodiments from 1 to 5 and comparative examples from 1 to 4;

FIG. 6 shows measuring results of heat resistance test and quality of heat resistance in embodiments from 1 to 5 and comparative examples from 1 to 4; and FIG. 7 shows existence of interference fringes and image properties in embodiments from 1 to 5 and comparative examples from 1 to 4.

DESCRIPTION OF PREFERRED EMBODIMENTS

Figure 1:
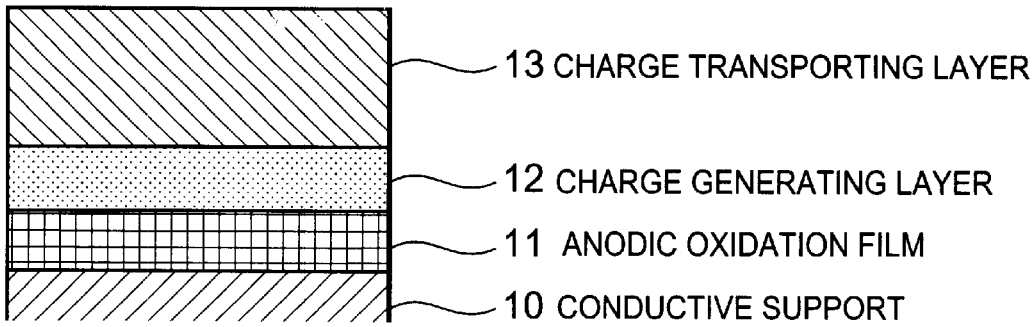
FIG. 1 is a partial cross-sectional view of the electrophotographic photoreceptor of one embodiment according to the present invention.

As shown in FIG. 1, the electrophotographic photoreceptor according to the present embodiment is particularly constituted of a conductive support 10 consisting of aluminum or aluminum alloy, an anodic oxidation film 11 formed on the conductive support 10, a charge generating layer 12 applied on the anodic oxidation film 11, and a charge transporting layer 13 applied on the charge generating layer 12.

The surface roughness of the conductive support 10 is processed by a high precision processing lathe using a tool with moderately buried diamond chips so that the maximum height Ry is 0.8 $\mu$m or more when the reference length of 0.25 mm is measured, and the maximum height Ry is 2.0 $\mu$m or less when the reference length of 0.8 mm is measured. This can make the reflectivity of the light on the surface of the conductive support 10 to be equal to or less than 35% of a quantity of exposure light of a light source of a coherent light of 700 nm or more.

The reasons will be described hereinafter in which the electrophotographic photoreceptor according to the present invention can prevent occurrence of interference fringes and have excellent image property without an image defective.

A laser light which has transmitted through the charge generating layer is reflected on the surface of the conductive support 10 to become a reflected light, and the reflected light synchronizes with an incident light, so that the interference fringes are produced. Components of the reflected light are substantially decreased on the surface of the conductive support 10, which surface has been made rough according to the method described above, and the components of the reflected light are suppressed so that, even if they interfere with the incident light, fluctuation of a quantity of the positive incident light is not affected, or fluctuation of an amount of charge produced in the charge generating layer 12 is not influenced, thereby the interference fringes are not made visible.

Local image failure arises from lowering a local surface potential resulting from influence of projects. The cause of lowering a local potential is such that projects on the surface of the conductive support (anodic oxidation film) stand out into the charge generating layer, causing local reductions of the film thickness. In the present invention, as the surface roughness of the conductive support 10 is defined as described above, the local reductions of the film thickness are hardly occurred.

The occurrence of the local image failure is also caused by crystallized particles on the surface of the anodic oxidation film 11 and size and number of pits due to dropping of the crystallized particles. Fine defectives on the surface of the anodic oxidation film 11 due to the crystallized particles cause local charge injection between the anodic oxidation film and the photoconductive layer composed of the charge generating layer and the charge transporting layer.

However, by making the average of diameters of crystallized particles on the anodic oxidation film to be 3 $\mu$m or less and the distribution of the crystallized particles to be 1000/$mm^2$ or less, recesses, referred to as pits, are not occurred on the conductive support and the surface figuration is improved, contributing to formation of an excellent image.

In the conductive support 10, elements other than aluminum effect to elevate mechanical strength and improve cutting machining ability, however, on the other hand, most of the crystallized particles originate from them, so that such condition becomes necessary that Fe is 0.1 weight percent or less, Mg 0.4 to 0.6 weight percent or less, and Mn 0.1 weight percent or less.

The electrophotographic photoreceptor according to the present invention is produced by providing the photoconductive layer after the anodic oxidation film is provided on the conductive support 10 obtained by cutting-processing the surface of the photoreceptor as described above. Preferably, the material of the conductive support 10 is aluminum alloy of 6000 series in JIS Standard. It is desirable that the conductive support 10 is, before subjected to anode oxidation treatment, degrease-processed with an organic solvent, such as alkylene, or a surface-active agent or an emulsified degreasing agent, and is followed by etching processing.

The anodic oxidation film can be formed by known methods, for example, by the anode oxidation processing in an acid solution bath, such as sulfuric acid, oxalic acid, chromic acid, and boric acid, and the anode oxidation treatment in the sulfuric acid solution is desirable.

The reason is because the characteristics as an acid are stable so that stable films can be obtained. The processing is performed such that the concentration of sulfuric acid is 100 to 200 g/l, the concentration of aluminum ions is 1 to 10 g/l, the temperature of the solution is approximately 25 degrees Centigrade, the electrolytic voltage is approximately 20 V, and the electric current density is 0.5 to 2 $A/dm^2$, but it is not so limited.

The anodic oxidation film formed is subjected to the absorption process. For example, when the anodic oxidation film is subjected to the absorption process by immersing in an aqueous solution containing the acetic acid nickel, it is desirable to perform the process under such conditions that the concentration is 5 to 10 g/l, the treatment temperature is 40 to 60° C., the treatment time is 4 to 10 minutes, and pH is in a range from 4 to 6. The film thickness of the anodic oxidation film is 20 $\mu$m or less, preferably, 5 to 10 $\mu$m. The anodic oxidation film thus formed is washed with pure water, if necessary.

Incidentally, the photoconductive layers are laminated in serial manner using organic materials described below on the anodic oxidation film described above, and in order to form it uniformly and stably, paints with good scattering property and solubility are needed. Therefore, a variety of solvents, particularly, solvents with high boiling point are used, and in order to eliminate the solvent components, a drying process in high temperature is needed. Natural oxidation tends to progress in the anodic oxidation film, and if the progress exceeds a criterion value, cracks will be occurred in the surface during the drying process, so that admittance of 0.4 $S/m^2$ or more was found to be needed, after examining the states with high heat resistance. And also, considering blocking effect, if the admittance is not suppressed equal to or less than 80 $S/m^2$, the anodic oxidation film did not fully function and the deterioration of the electrification property was observed.

The admittance of the anodic oxidation film 11 formed in the above-described manner can be measured in the following way. A nonconductive cell is mounted on a surface of a sample under room temperature, and after leaving 30 minutes in such a condition that the cell is filled with potassium sulfate solution of 3.5 weight percent, one electrode of an admittance measuring apparatus is connected to the aluminum conductive support 10, and the other electrode is inserted into a cell filled with aqueous solution to measure admittance Y under frequency of 1 kHz.

(Testing method JIS H8683)

Figure 2:
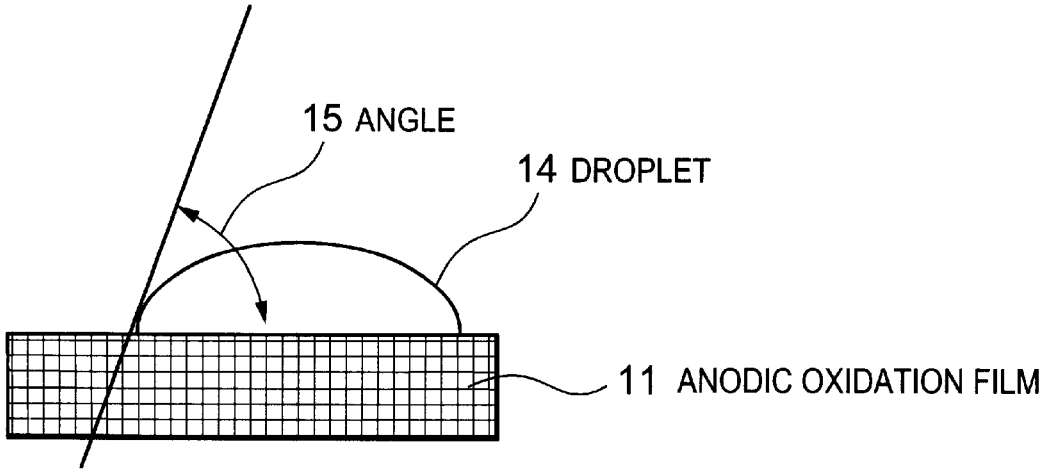
FIG. 2 is a side view showing a method for measuring a contact angle which assesses a wettability of a surface of the anodic oxidation film shown in FIG. 1.

It is determined by a relation between the processing temperature and the immersing time to set the admittance values to be measured within 0.4 to 30 $S/M^2$, however, at the same time, it is added to the determination that contact angles made by pure water exist in a range from 30 degrees to 80 degrees. As shown in FIG. 2, a contact angle is defined as an angle 15 of a droplet 14 of pure water dropped on the anodic oxidation film 11.

The photoconductive layer provided on the anodic oxidation film is laminated at least in the sequence of the charge generating layer and charge transporting layer, however, various intermediate layers can also be provided between the anodic oxidation film and the photoconductive layer. The intermediate layers can be made from polyamide, polyvinyl alcohol, polyurethane, polyacrylic acid, or epoxy resin, and various addition agents such as conductive fine particles can be mixed with these resins. These layers may be a single layer or a laminator of two or more layers. It is appropriate that the film thickness of the intermediate layer is 1 to 10 $\mu$m, preferably in a range from 0.2 to 4 $\mu$m.

In terms of the charge generating layer, known charge generating materials, for example, such as metal-free phthalocyanine pigment, metal phthalocyanine pigment, azo pigment, disazo pigment, indigo pigment, or quinacridom pigment, are used. These charge generation materials can be used individually or in combination with two or more kinds. In order to form a charge generating layer, a charge generating material is dispersed into a binder resin. As the binder resin, polyvinyl chloride, polyvinyl acetate, polyvinyl butyral, polyvinyl formal, polyester, polyurethane, polycarbonate, acrylic resin, or phenol resin is used individually or in combination with two or more kinds.

The charge generating layer is formed by applying a paint on the anodic oxidation film, which paint is made by dissolving or dispersing a charge generating material and a binder in a solvent, such as toluene, xylene, monochlorobenzene, methyl alcohol, ethyl alcohol, ethyl acetate, methylene chloride, tetrahydrofuran, or cyclohexane. These solvent is used individually or in combination with two or more kinds. These application are performed using a known technique, such as spin cotar, applicator, spray cotar, bar cotar, dip cotar, or doctor blade. It is appropriate that the film thickness of the charge generating layer is 0.05 to 5 $\mu$m, preferably in a range from 0.1 to 2 $\mu$m.

The charge transporting layer formed on the charge generating layer is formed by applying a paint for the charge transporting layer on the charge generating layer, which paint is constituted by dissolving or dispersing charge transporting materials and a binder resin for dispersing and fixing them in a solvent. For the paint for the charge transporting layer, an addition agent, such as antioxidant, surface lubricant, ultraviolet absorbent, can be used. As charge transporting materials, known materials can be used, such as poly-N-vinylcarbazole and its derivative, pyrene-formaldehyde condensate and its derivative, polysilane and its derivative, oxazole derivative, oxadiazole derivative, monoallylamine derivative, diarylamine derivative, triarylamine derivative, stilbene derivative, benzidine derivative, pyrazoline derivative, hydrazone derivative, and butadiene derivative. The charge transporting materials can be used individually or in combination with two or more kinds. As a binder resin for dispersing and fixing a charge transporting material, polyvinyl chloride, polyvinyl acetate, polyvinyl butyral, polyvinyl formal, polyester, polyurethane, polycarbonate, acrylic resin, or phenol resin is used. These resin can be used individually or in combination with two or more kinds. As a solvent, toluene, xylene, monochlorobenzene, methyl alcohol, ethyl alcohol, ethyl acetate, methylene chloride, tetrahydrofuran, or cyclohexane can be used. These solvents can also be used individually or by mixing. The application of the charge transporting layer is performed using a known technique, such as spin cotar, applicator, spray cotar, bar cotar, dip cotar, or doctor blade. It is appropriate that the film thickness of the charge transporting layer is 5 to 40 μm, preferably in a range from 15 to 25 μm.

The electrophotographic photoreceptor obtained according to the present invention has excellent image characteristics having high gradient without defectives such as fine black spots, without mentioning occurrence of fogs, under wide operating environment including high temperature and humidity conditions.

EXAMPLE

Next, the present invention will be explained in the concrete with reference to embodiments, but is not limited to the following embodiments so long as its spirits are not exceeded.

As a material of the conductive support 10, an aluminum alloy of 6000 series in JIS Standard was used, which aluminum alloy was subjected to a hot extrusion process to obtain a cylindrical aluminum bare tube with an external diameter of approximately 30 mm and a length of approximately 350 mm. Using a tool with a blade edge in which sintered diamond chips of a moderate density are adjusted, precise cutting processing for the surface of the bare tube was performed. After the surface cutting has been completed, the bare tube was subjected to degrease and washing process with an organic solvent and followed by etching process, and subsequently, after washed with water, it was subjected to an anode oxidation treatment for 15 minutes using sulfuric acid with a concentration of 150 g/l as an electrolyte solution while maintaining DC voltage of 20 V and the solution temperature of 25° C., thereby the anodic oxidation film with average film thickness of 7 μm was formed. Then, after washed, an absorption process was performed using the acetic acid nickel based solution with concentration of 6 g/l. Subsequently, after fully washed and dried, the conductive supports (alumetized bare tubes) a to i subjected to the anode oxidation process were obtained.

Figure 3:
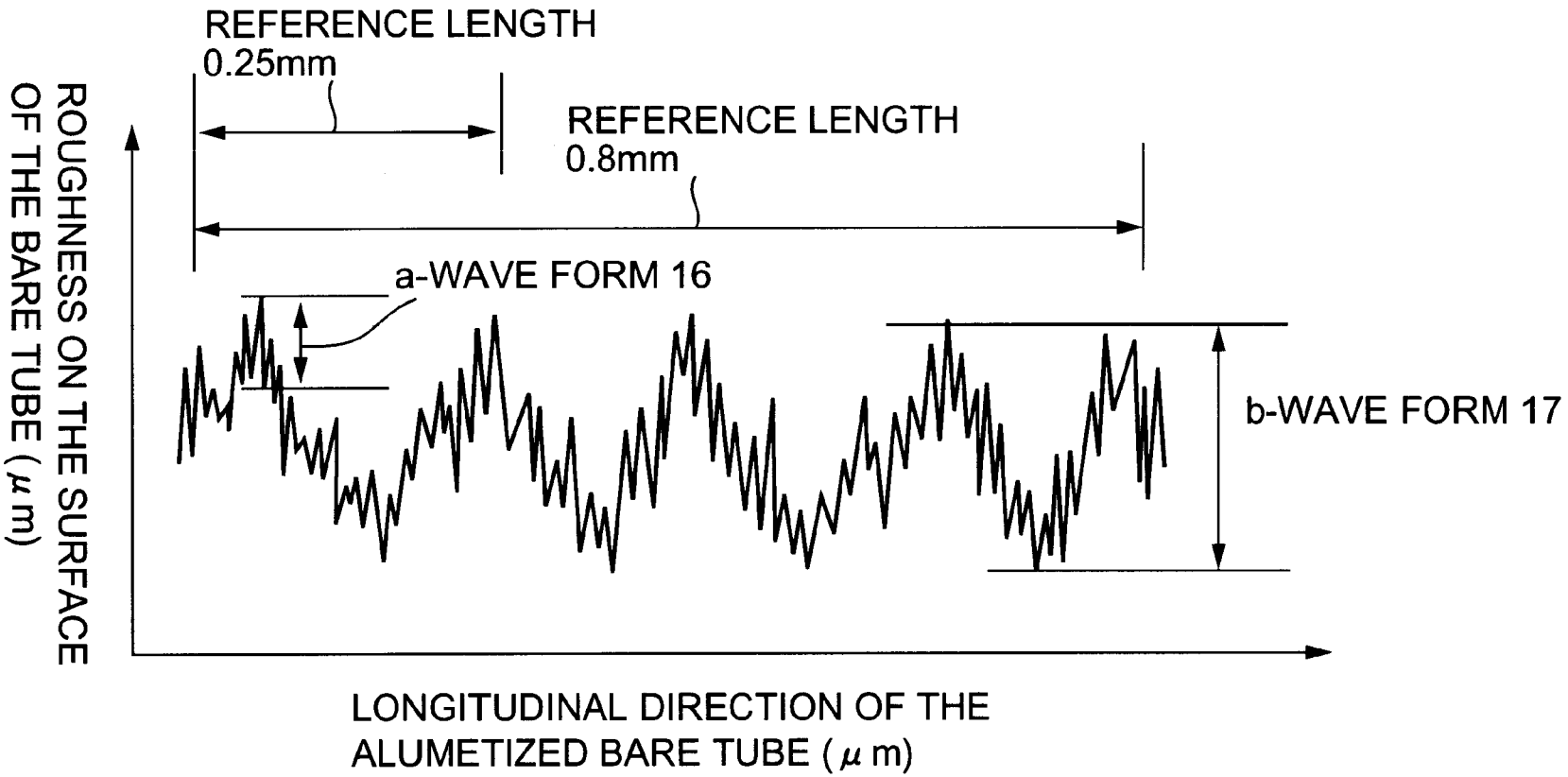
FIG. 3 is a waveform view showing a roughness waveform on a surface of an alumetized bare tube.

As shown in FIG. 3, the roughness waveform is composed of at least an a-waveform 16 of short waveform components and a b-waveform 17 of long waveform components. FIG. 3 also shows a conceptual positional relationship of the reference length of 0.25 mm and the reference length of 0.8 mm relative to the roughness waveform when the surface roughness Ry is measured. Values in the roughness measurement and reflectivity on the surfaces of the alumetized bare tube obtained in this manner are shown in FIG. 4.

Furthermore, admittance per unit area of the anodic oxidation films, contact angles due to pure water, and maximum diameters and numbers of crystallized particles and pits on the surface of the bare tube obtained on an image analysis device by observing the surface of the bare tube with an electron microscope are shown in FIG. 5.

In addition, heat resistance test was conducted in order to observe existence of occurrence of cracks due to heating of the alumetized bare tube obtained, and its results are shown in FIG. 6.

Embodiments 1 to 3

The charge generating layer having a thickness of approximately 0.2 μm was formed by applying a paint to alumetized bare tubes obtained a to c and drying by heating them, which paint was produced by adding 2.5 parts by weight τ type metal-free phthalocyanine and 2 parts by weight polyvinyl butyral to 100 parts by weight tetrahydrofuran solution and by dispersing the solution for 24 hours in a ball mill.

Next, after 14 parts by weight 2-methyl-4-dibenzyl amino-benzaldehyde-N,N-diphenyl hydrazone, 6 parts by weight 1,1-bis(palladiethyl aminophenyl)-4,4-diphenyl-1,3-butadiene, and 20 parts by weight polycarbonate (Z-400, which is a product put on the market from Mitsubishi Gas Chemical) were dissolved in 100 parts by weight methylene chloride to immerse and apply on the charge generating layer, the layer was dried by heating to form a charge transporting layer having a thickness of approximately 20 μm, thereby producing the electrophotographic photoreceptors.

Embodiments 4 to 5

The charge generating layer having a thickness of approximately 0.15 μm was formed by applying a paint to alumetized bare tubes obtained d to e and drying by heating them, which paint was produced by adding 2 parts by weight titanyl phthalocyanine and 2 parts by weight polyvinyl butyral to 100 parts by weight tetrahydrofuran solution and by dispersing the solution for 24 hours in a ball mill.

Next, after 18 parts by weight α-phenyl-4-N,N-bis(4-methylphenyl)aminostilbene and 20 parts by weight polycarbonate (Z-400, Mitsubishigasukagaku) were dissolved in 95 parts by weight tetrahydrofuran to immerse and apply on the charge generating layer, the layer was dried by heating to form a charge transporting layer having a thickness of approximately 20 μm, thereby producing the electrophotographic photoreceptors.

The electrophotographic photoreceptors obtained in this way are referred to as drums A to E.

Comparative Examples 1 to 4

Using the alumetized bare tubes obtained f to i, the electrophotographic photoreceptors were produced by the same method as Embodiment 1, which were referred to as drums F to I.

The drums prepared in the manner as discussed above were mounted in a page printer type PC-PR2000/6W manufactured by NEC, and image characteristics were assessed under each environment of 25° C. and 50% RH, 10° C. and 20% RH, and 35° C. and 80% RH. The assessment result is shown in FIG. 7.

Referring to FIGS. 4 and 7, a surface roughness Ry of 0.8 μm or more was necessary under the measuring condition of the reference length of 0.25 mm with respect to an alumetized bare tube (aluminum conductive support 10 in FIG. 1) which was effective for preventing the interference fringes in image forming (in particular, image with high gradient).

According to JIS Standard, the standard value in the measuring method for the roughness of the conductive support is reference length of 0.8 mm, in the case when Ry is in a range exceeding 0.8 μm and equal to or less than 6.3 μm.

However, even if the roughness of a drum with interference fringes is measured with the reference length of 0.8 mm, the roughness distribute over a wide range, so that the regularity was not able to be found. Then, when the roughness waveform on the surface of the bare tube was examined, it was proven that the roughness waveform was constituted of two or more components such as long waveform components (b-waveform) with some swell based on feed speed of a cutting bite during cutting process, as shown in FIG. 3, and short waveform components (a-waveform) based on transcription of a blade edge of the cutting bite, so that the regularity of occurrence of interference fringes was found with roughness measuring method considering the short waveform components.

As a result of the experiments, it was found that the surface roughness subjected to an anode oxidation treatment preferably had a roughness waveform composed of two components shown in the following equation, a pitch between projects of asperities in an a-waveform of first component is 5 to 20 $\mu$m, and a pitch between projects of asperities in a b-waveform of second component is 200 to 400 $\mu$m.

$$1.0a \leqq b \leqq 2.5a \qquad \text{Equation (1)}$$

wherein:

a is the roughness of the short waveform (fine roughness) component;

b is the roughness of the long waveform (coarse roughness) component.

By fulfilling Equation (1), the reflectivity of light on the surface of the conductive support was able to be kept to equal to or less than 35% of a quantity of exposure light of a light source of a coherent light of 700 nm or more, so that black spots in an image and occurrence of fogs under the high temperature and humidity environment were able to be more fully suppressed.

It was found that interference fringes did not occur, when the reflectivity of light with the same wavelength as a laser light on the bare tube was equal to or less than 35% of a quantity of exposure light of a light source.

Referring to FIG. 5, in order to obtain an excellent image, maximum diameters of crystallized particles and pits were 3 $\mu$m or less respectively, and also their numbers were less than 1000/mm$^2$. The drums made using these alumetized bare tubes had excellent images without black spots, so that to obtain an excellent image is proven to be influenced by the maximum diameter and number of crystallized particles and pits.

Further, although a crack due to the heat resistance test did not occur in the alumetized bare tubes a to e and h, i, uncountable cracks occurred in the alumetized bare tubes f and g. It is proven that admittance values are low and oxidation on the surface has proceeded.

When the image characteristics were assessed under each environment, an excellent image without an image failure such as black spots and fogs as well as interference fringes was able to be obtained in the drums A to E under every environment, however, image failures existed in the drums F to I, and particularly, serious and impractical fogs occurred under high temperature and humidity conditions.

Also, when admittance of the anodic oxidation film is less than 0.4 S/m$^2$, heat resistant property becomes worse and cracks tend to occur. When it is more than 30 S/ms, blocking effect does not work sufficiently, resulting in lowering of the electrification property. The contact angle becomes a barometer for assessing a wettability of a paint, when the photoconductive layer is formed. When the wettability is less than 30 degrees, the absorption property is large and the paint tends to adhere dust particles in air, so that the leveling of the paint is suppressed, thereby coating irregularity and black spots tend to occur. On the contrary, when the wettability is more than 80 degrees, the absorption property becomes small, causing the leveling to be easily performed, however, when concentration of the paint and coating speed are varied in order to keep the image density constant, the resultant coating irregularity occurred.

Incidentally, it is apparent that the present invention is not limited to the above-described embodiment and each embodiment can appropriately be modified without departing from the scope of this invention.

As the present invention is constituted as described above, it is provided with the following effects.

The present invention provides an electrophotographic photoreceptor which prevents occurrence of interference fringes and realizes to obtain excellent images without black spots and fogs under every environment, according to the basic construction which optimizes the measuring conditions of Ry of the conductive support 10 used in the electrophotographic photoreceptor and subjected to the processing for the anodic oxidation film and controls together with the reflectivity, has the anodic oxidation film in which the admittance and the range of the contact angle are defined, and controls diameter and number of crystallized particles and pits appearing on the surface of the conductive support 10.

What is claimed is:

1. An electrophotographic photoreceptor in which a charge generating layer and a charge transporting layer are laminated on a conductive support, said electrophotographic photoreceptor comprising said conductive support which makes a quantity of reflected lights with respect to exposure of a coherent light to be small and is provided with a short wavelength surface roughness in order to suppress a quantity of interference lights produced by said reflected lights from and incident lights on a photoconductive layer formed by said charge generating layer and said charge transporting layer, wherein said conductive support has a conductive support surface whose maximum height (Ry) measured within the reference length of 0.25 mm is greater than or equal to 0.8 $\mu$m.

2. The electrophotographic photoreceptor according to claim 1, wherein said conductive support has a conductive support surface whose maximum height (Ry) measured within the reference length of 0.8 mm is less than or equal to 2.0 $\mu$m, said conductive support being composed of aluminum or aluminum based alloy.

3. The electrophotographic photoreceptor according to claim 2, wherein reflectivity of light on said conductive support surface is equal to or less than 35% of a quantity of exposure light of a light source of a coherent light of 700 nm or more.

4. The electrophotographic photoreceptor according to claim 1, wherein said electrophotographic photoreceptor has a conductive support surface which is processed for an anodic oxidation film and has a surface roughness, and said surface roughness has a roughness waveform composed of two components shown in a following equation:

$$1.0a \leqq b \leqq 2.5a$$

wherein:

a is a roughness of a short waveform (fine roughness) component;

b is a roughness of a long waveform (coarse roughness) component;

a pitch between projects of asperities in an a-waveform of a first component is 5 to 20 $\mu$m;

a pitch between projects of asperities in a b-waveform of a second component is 200 to 400 $\mu$m.

5. The electrophotographic photoreceptor according to any one of claim 4, wherein an asperity figuration of said conductive support surface is composed of only slope portions.

6. The electrophotographic photoreceptor according to claim 4, wherein:

a contact angle of said anodic oxidation film with pure water is in a range from 30 to 80 degrees, and admittance of said anodic oxidation film is in a range from 0.4 to 30 $S/m^2$.

7. The electrophotographic photoreceptor according to claim 6, wherein an average of diameters of crystallized particles on said anodic oxidation film is 3 $\mu$m or less and a distribution of said crystallized particles is $1000/mm^2$ or less.

8. The electrophotographic photoreceptor according to claim 7, wherein said conductive support is composed of Fe of 0.3 weight percent or less;

Mg of 0.4 to 0.6 weight percent or less; and

Mn of 0.1 weight percent or less.

9. The electrophotographic photoreceptor according to claim 6, wherein said anodic oxidation film is provided whose surface is absorption processed by an acetic acid nickel solution under conditions of treatment temperature of 40 to 65 degrees and treatment time of 4 to 10 minutes.

10. A manufacturing method of an electrophotographic photoreceptor in which a charge generating layer and a charge transporting layer are laminated on a conductive support, said manufacturing method of an electrophotographic photoreceptor comprising the steps of:

processing a conductive support surface with a high precision processing lathe using a tool with moderately buried diamond chips so that the maximum height Ry of said conductive support measured within the reference length of 0.25 mm is equal to or more than 0.8 $\mu$m; and absorption processing a surface of an anodic oxidation film with an acetic acid nickel solution.

11. The manufacturing method of an electrophotographic photoreceptor according to claim 10, wherein said absorption process with said acetic acid nickel solution is performed under conditions of:

a treatment temperature of 40 to 60° C.; and a treatment time of 4 to 10 minutes.

12. The manufacturing method of an electrophotographic photoreceptor according to claim 10, wherein:

a material of said conductive support is aluminum alloy of 6000 series in JIS Standard;

said conductive support is degrease-processed with an organic solvent, or a surface-active agent or an emulsified degreasing agent;

said conductive support is etching-processed;

said conductive support is anode-oxidation processed in an acid solution bath;

an anodic oxidation film is formed on said conductive support surface;

said anodic oxidation film is immersed in an aqueous solution containing acetic acid nickel to subject to an absorption process;

said charge generating layer is laminated on said anodic oxidation film; and said charge transporting layer is laminated on said charge generating layer.

13. The manufacturing method of an electrophotographic photoreceptor according to claim 12, wherein:

one or more intermediate layers composed of a resin or resins including conductive particulate is laminated on said anodic oxidation film before said charge generating layer is laminated.

* * * * *